United States Patent [19]

Hosaka

[11] 4,174,689

[45] Nov. 20, 1979

[54] ELECTRONIC CLOSED LOOP AIR-FUEL RATIO CONTROL SYSTEM

[75] Inventor: Akio Hosaka, Yokohama, Japan

[73] Assignee: Nissan Motor Company, Limited, Japan

[21] Appl. No.: 780,688

[22] Filed: Mar. 23, 1977

[30] Foreign Application Priority Data

Mar. 24, 1976 [JP] Japan ..... 51-31449

[51] Int. Cl.[2] ..... F02B 3/00

[52] U.S. Cl. ..... 123/119 EC; 123/32 EE

[58] Field of Search ..... 123/119 EC, 124 B, 119 D, 123/32 EE; 60/276, 285

[56] References Cited

U.S. PATENT DOCUMENTS

| | | | |
|---|---|---|---|
| 3,745,768 | 7/1973 | Zechnall et al. | 123/32 EE |
| 3,948,228 | 4/1976 | Luchaco | 123/32 EE |
| 4,023,357 | 5/1977 | Masaki | 123/119 EC |
| 4,029,061 | 6/1977 | Asano | 60/276 |
| 4,046,118 | 9/1977 | Aono | 123/119 EC |
| 4,056,932 | 11/1977 | Nakamura et al. | 123/119 D |
| 4,057,042 | 11/1977 | Aono | 123/119 EC |
| 4,061,117 | 12/1977 | Ikeura | 123/119 EC |

*Primary Examiner*—Charles J. Myhre
*Assistant Examiner*—R. A. Nelli
*Attorney, Agent, or Firm*—Lowe, King, Price & Becker

[57] ABSTRACT

A differentiator is provided in an electronic closed loop air-fuel ratio control system to speed up a response of the system and also to precisely control an air-fuel ratio of the air-fuel mixture fed to the engine.

3 Claims, 16 Drawing Figures

CONTROL UNIT
CATALYTIC CONVERTER
ENGINE
10
8
2
4
6
30
16
14
20
18
24
22
26
27
33
34
32
36
40

V3

V4

V5

V6

V7

V8

V9
VS1
VS2

V10

V11

V12
T

ELECTRONIC CLOSED LOOP AIR-FUEL RATIO CONTROL SYSTEM

The present invention relates generally to an electronic closed loop air-fuel ratio control system for an internal combustion engine, and more particularly to an improvement in such a system for speeding up a response of the system and also precisely regulating an air-fuel mixture ratio.

Various systems have been proposed to supply an optimal air-fuel mixture to an internal combustion engine in accordance with the mode of engine operation, one of which is to utilize the concept of an electronic closed loop control system based on a sensed concentration of a component in exhaust gases of the engine.

According to the conventional system, an exhaust gas sensor, such as an oxygen analyzer, is deposited in the exhaust pipe for sensing a concentration of a component of exhaust gases from an internal combustion engine, generating an electrical signal representative of the sensed component. A differential signal generator is connected to the sensor for generating an electrical signal representative of a differential between the signal from the sensor and a reference signal. The reference signal is previously determined in due consideration of, for example, an optimum ratio of an air-fuel mixture to the engine for maximizing the efficiency of both the engine and an exhaust gas refining means. A control signal generator, which consists of a so-called proportional-integral (p-i) controller and an adder, is connected to the differential signal generator, receiving the signal therefrom to speed up a response of the system and also to make the operation of the system stable. A pulse generator is connected to the control signal generator, generating a train of pulses which is fed to an air-fuel ratio regulating means, such as electromagnetic valves, for supplying an air-fuel mixture with an optimum air-fuel ratio to the engine.

In the previously described control system, however, a problem is encountered that the response of the system is not quick to a desirable extent. This is because the conventional system has been designed under the assumption that the output of the exhaust gas sensor takes only two discrete conditions, so that the control signal generator does not include a differentiator. This defect inherent in the prior art will be discussed in connection with FIGS. 1 through 3 of the accompanying drawings.

It is therefore a primary object of the present invention to provide an improved electronic closed loop air-fuel ratio control system with comparatively quick response.

It is a further and more specific object of the present invention to provide an improved electronic closed loop air-fuel ratio control system which includes a differentiator for speeding up the response of the system and also for precise control of an air-fuel mixture ratio.

These and other objects, features and many of the attendant advantages of the present invention becomes better understood by the following detailed description, wherein like parts in each of the several figures are identified by the same reference characters, and wherein:

FIG. 1 schematically illustrates a conventional electronic closed loop air-fuel ratio control system for regulating the air-fuel ratio of the air-fuel mixture fed to an internal combustion engine;

Figure 4:
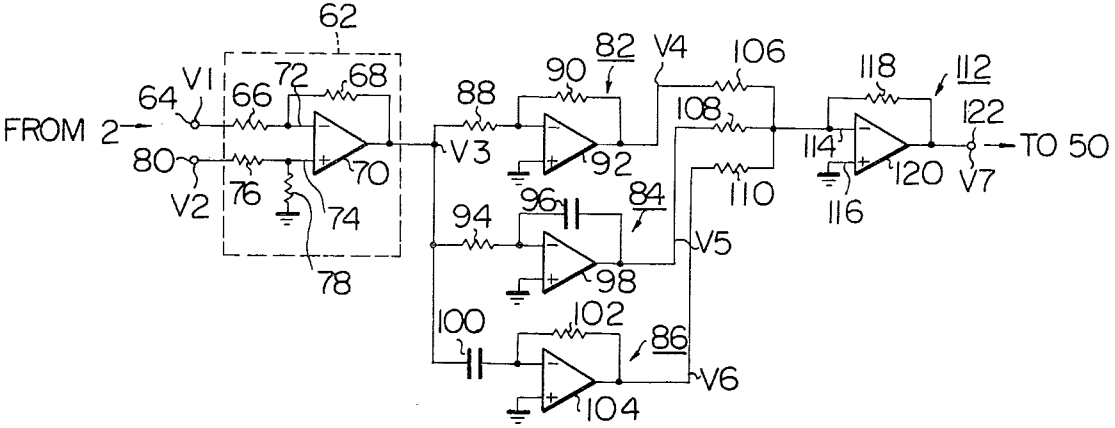
FIG. 4 is a first preferred embodiment of the present invention.
Figure 6:
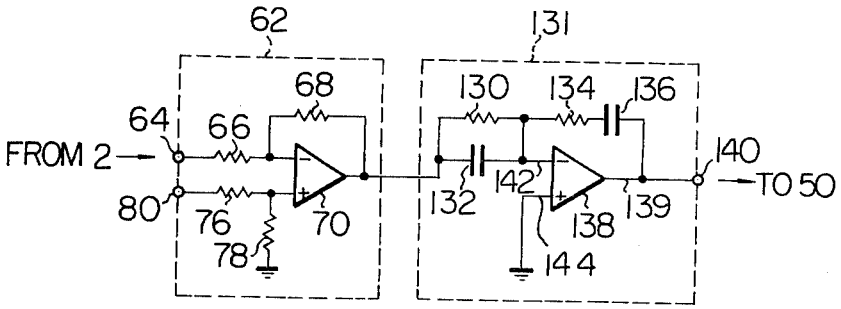
Figure 7:
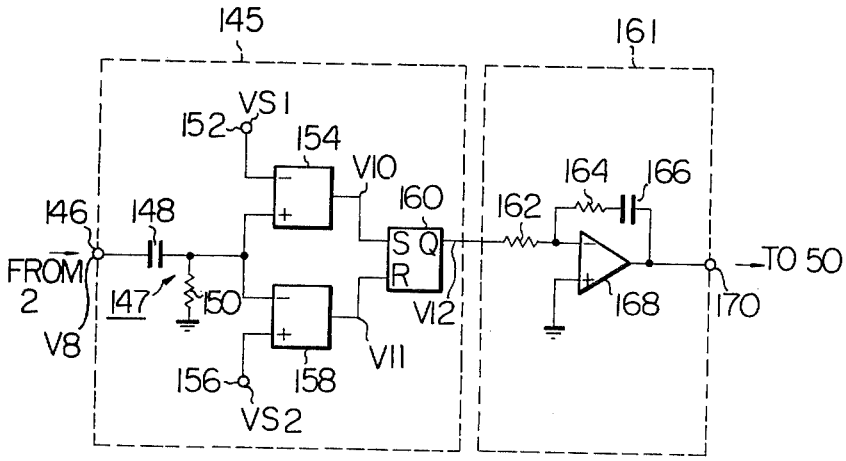

FIGS. 5*a*–5*e* are graphs showing waveforms of signals appearing at various parts of the circuit of FIG. 4 in comparison with waveforms of signals according to prior art;

FIG. 6 is a second preferred embodiment of the present invention;

FIG. 7 is a third preferred embodiment of the present invention; and

FIGS. 8*a*–8*e* are graphs showing waveforms of signals appearing at various parts of the circuit of FIG. 7.

Figure 1:
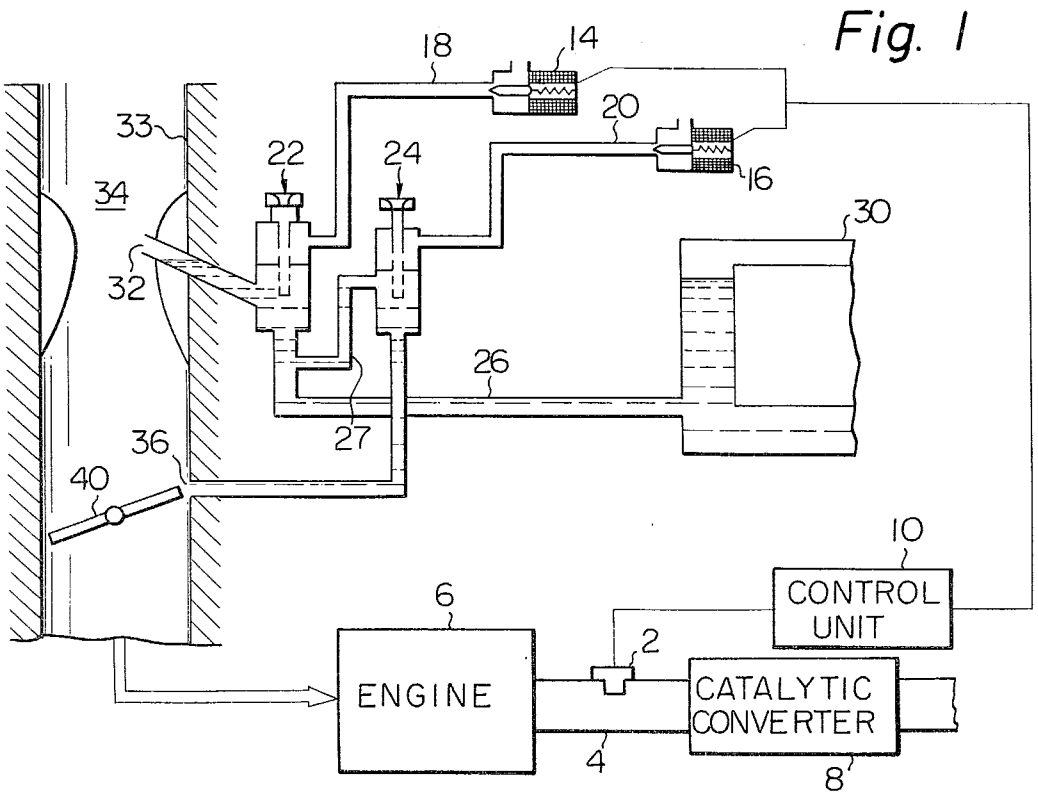

Reference is now made to drawings, first to FIG. 1, which schematically exemplifies in a block diagram a conventional electronic closed loop control system with which the present invention is concerned. The purpose of the system of FIG. 1 is to electrically control the air-fuel ratio of an air-fuel mixture supplied to an internal combustion engine 6 through a carburetor (no numeral). An exhaust gas sensor 2, such as an oxygen, CO, HC, $NO_x$, or $CO_2$ analyzer, is disposed in an exhaust pipe 4 in order to sense the concentration of a component in exhaust gases. An electrical signal from the exhaust gas sensor 2 is fed to a control unit 10, in which the signal is compared with a reference signal to generate a signal representing a differential therebetween. The magnitude of the reference signal is previously determined in due consideration of an optimum air-fuel ratio of the air-fuel mixture supplied to the engine 6 for maximizing the efficiency of a catalytic converter 8. The control unit 10, then, generates a command signal, or in other words, a train of command pulses based on the signal representative of the optimum air-fuel ratio. The command signal is employed to operate two electromagnetic valves 14 and 16. The control unit 10 will be described in more detail in conjunction with FIG. 2.

The electromagnetic valve 14 is provided in an air passage 18, which terminates at one end thereof at an air bleed chamber 22, to control the rate of air flowing into the air bleed chamber 22 in response to the command pulses from the control unit 10. The air bleed chamber 22 is connected to a fuel passage 26 for mixing air with fuel delivered from a float bowl 30, supplying the air-fuel mixture to a venturi 34 through a discharging (or main) nozzle 32. Whilst, the other electromagnetic valve 16 is provided in another air passage 20, which terminates at one end thereof at another air bleed chamber 24, to control a rate of air flowing into the air bleed chamber 24 in response to the command pulses from the control unit 10. The air bleed chamber 24 is connected to the fuel passage 26 through a fuel branch passage 27 for mixing air with fuel from the float bowl 30, supplying the air-fuel mixture to an intake passage 33 through a low speed nozzle 36 adjacent to a throttle 40. As shown, the catalytic converter 8 is provided in the exhaust pipe 4 downstream of the exhaust gas sensor 2. In this case, for example, the electronic closed loop control system is designed to set the air-fuel ratio of the air-fuel mixture to about stoichiometry. This is because the three-way catalytic converter is able to simultaneously and most effectively reduce nitrogen oxides ($NO_x$), carbon monoxide (CO), and hydrocarbons (HC), only when the air-fuel mixture ratio is set at about stoichiometry. It is apparent, on the other hand, that, when other catalytic converter such as oxidizing or deoxidizing type is employed, case by case setting of an air-fuel mixture ratio, which is different from the above, will be required for effective reduction of noxious components.

Figure 2:
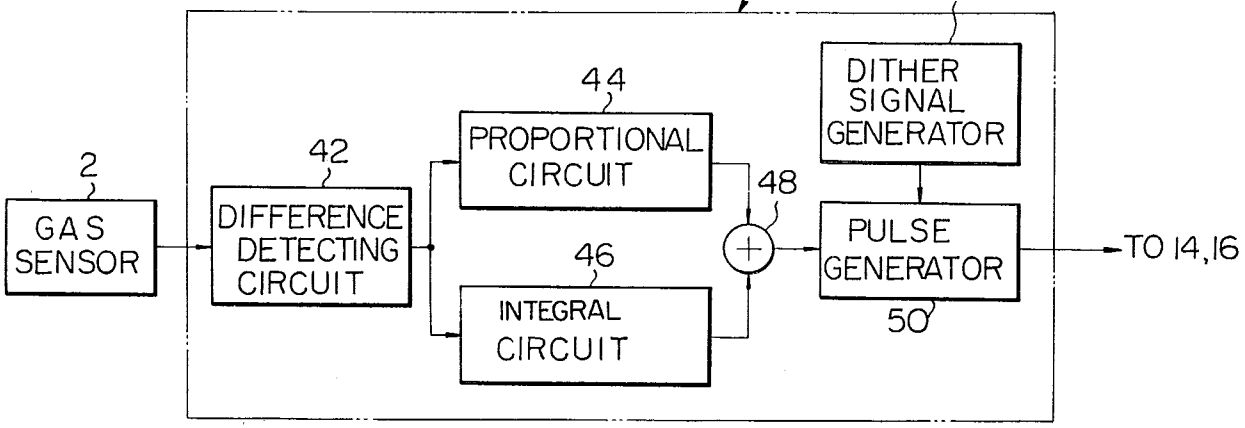
Fig. 2 PRIOR ART
FIG. 2 is a detailed block diagram of an element of the system of FIG. 1.

Reference is now made to FIG. 2, in which somewhat detailed arrangement of the control unit 10 is schematically exemplified. The signal from the exhaust gas sensor 2 is fed to a difference detecting circuit 42 of the control 10, which circuit compares the incoming signal with a reference one to generate a signal representing difference therebetween. The signal from the difference detecting circuit 42 is then fed to two circuits, viz., a proportional circuit 44 and an integration circuit 46 of a control signal generator 43. The purpose of the provision of the proportional and the integration circuits 44 and 46 is, as is well known to those skilled in the art, to increase both a response characteristic and stability of the system. The signals from the circuits 44 and 46 are then fed to an adder 48 in which the two signals are added. The signal from the adder 48 is then applied to a pulse generator 50 to which a dither signal is also fed from a dither signal generator 52. The command signal, which depends upon the adder 48 and is in the form of pulses, is fed to the valves 14 and 16, thereby to control the "on" and "off" operation thereof.

In FIGS. 1 and 2, the electronic closed loop air-fuel ratio control system is illustrated together with a carburetor, however, it should be noted that the system is also applicable to a fuel injection device.

Figure 3:
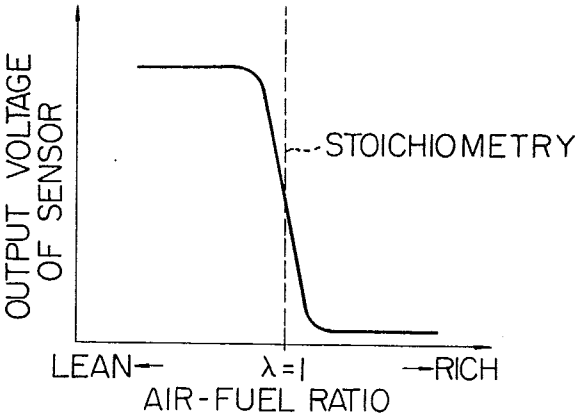
FIG. 3 is a graph showing an output voltage of an exhaust gas sensor as a function of an air-fuel ratio of the air-fuel mixture fed to an internal combustion engine.

As seen from the above, the control signal generator 43 includes the proportional circuit 44 and the integrator 46, but, not a differentiator. This results from the following facts: (1) the output of the exhaust gas sensor such as an oxygen analyzer takes, in broad perspective, substantially only two values as seen from the graph of FIG. 3, and (2) the difference detecting circuit 42 has a considerably high amplification degree so that the output of the circuit 42 takes only two values viz., a higher or a lower one. As a consequence of the foregoing, the conventional control system does not include any differentiator in that it does not serve to speed up the response of the system under such a condition. However, it is understood, when carefully examining the output characteristic of the exhaust gas sensor, that the output of the sensor changes continuously in proportion of the air-fuel ratio in the vicinity of the stoichiometry. The air-fuel ratio range wherein the sensor output changes continuously is usually about ±0.2–0.5 with respect to the stoichiometry. It is therefore considerably important to take into account the continuous change of the sensor output in the vicinity of the stoichiometry so as to precisely and quickly control the air-fuel mixture ratio. In this case, the amplification degree of a difference detecting circuit used, which corresponds to the circuit 43, is suppressed in order that the output thereof is not saturated. The present invention therefore contemplates speeding up the response of the system by providing a differentiator therein and also precisely controlling the air-fuel mixture ratio.

For detailed description of the present invention, reference is now made to FIGS. 4 and 5a–5e. FIG. 4 depicts a first preferred embodiment of the present invention, and FIGS. 5a–5e are graphs showing, by solid lines, waveforms of signals appearing at various parts of the circuit of FIG. 4 and also showing, by broken lines, waveforms of signals in the prior art for better understanding of the present embodiment.

The exhaust gas sensor 2 of FIG. 1 is connected to a differential amplifier 62, supplying its output V1 to the same. The differential amplifier 62 corresponds to the difference detecting circuit 42 of FIG. 2. The input terminal 64 is connected through a resistor 66 to an inverting terminal 72 of an operational amplifier 70 across which a resistor 68 is provided. A non-inverting input terminal 74 of the operational amplifier 70, which is grounded through a resistor 78, is connected to a terminal 80 over a resistor 76. The differential amplifier 62 receives a reference signal V2 at the terminal 80, generating a signal representative of a differential between the magnitudes of the signal V1 from the exhaust gas sensor 2 and the reference signal. The output of the differential amplifier 62, which is denoted by reference character V3, is then fed to a proportional circuit 82, an integrator 84, and a differentiator 86. The proportional circuit 82 consists of two resistors 88 and 90 and an operational amplifier 92, and the integrator 84 consists of a resistor 94 and a capacitor 96 and an operational amplifier 98, and finally the differentiator 86 consists of a capacitor 100, a resistor 102, and an operational amplifier 104. Outputs signals V4, V5, and V6 of the circuits 82, 84, and 86 are fed to an inverting input terminal 114 of an operational amplifier 120 through resistors 106, 108, and 110, respectively. The amplifier 120 forms an adder 112 together with a resistor 118. The adder 112 serves to add the signals V4, V5, and V6 therein, and feeding an added signal V7 through a terminal 122 to the next stage, viz., the pulse generator 50 of FIG. 2. In the circuit of FIG. 4 following relationships are obtained:

$$V3 = (V2 - V1)\frac{R_{68}}{R_{66}} = (V2 - V1)\frac{R_{78}}{R_{76}} \quad (1)$$

$$V4 = -\frac{R_{90}}{R_{88}} V3 \quad (2)$$

$$V5 = -\frac{1}{j\omega C_{96}R_{94}} V3 \quad (3)$$

$$V6 = -j\omega C_{100}R_{102}V3 \quad (4)$$

$$V7 = -\frac{R_{118}}{R_{106}} V4 - \frac{R_{118}}{R_{108}} V5 - \frac{R_{118}}{R_{110}} V6 \quad (5)$$

$$= -V3\left(\frac{R_{118}}{R_{106}}\frac{R_{90}}{R_{88}} + \frac{R_{118}}{R_{108}}\frac{1}{j\omega C_{96}R_{94}} + j\omega C_{100}R_{102}\right) \quad (6)$$

wherein $R_x$: resistance of a resistor denoted by a reference integer "x"

$C_{96}$: capacitance of the capacitor 96

$C_{100}$: capacitance of the capacitor 100

Figures 5A, 5B, 5C, 5D, 5E:
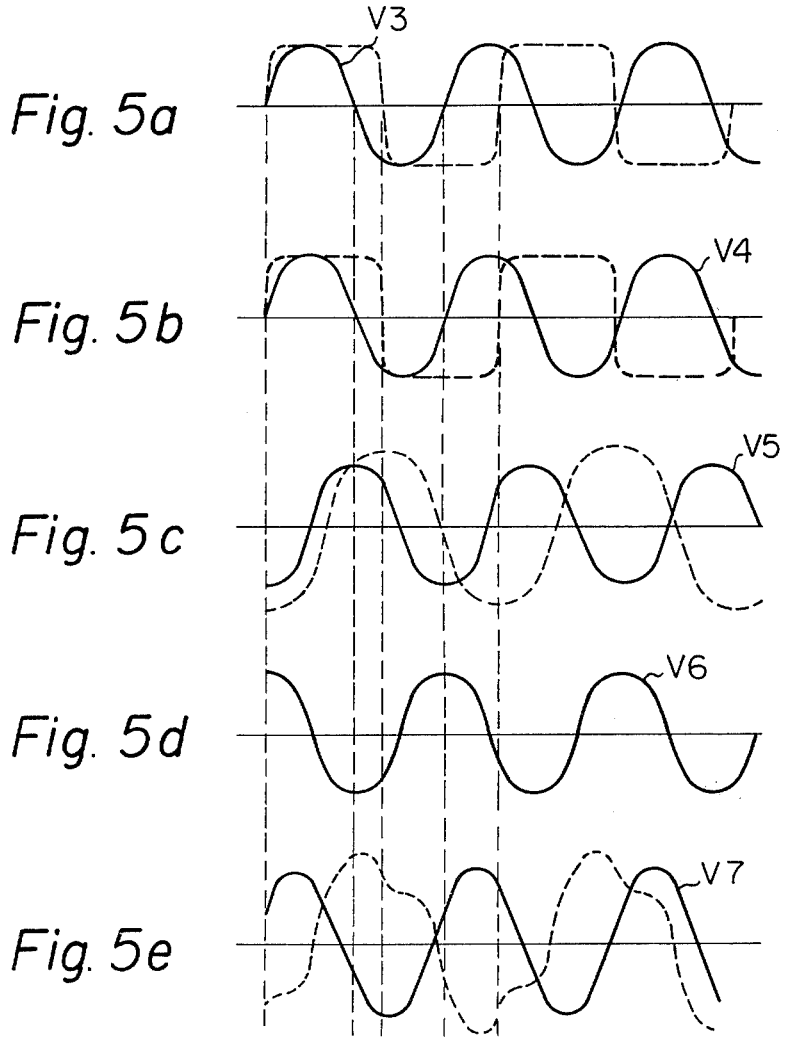

In FIGS. 5a–5e, the solid lines denote the waveforms of the signals V3-V7 of the FIG. 4 circuit and the broken lines depict waveforms of signals each of which appears at a corresponding portion of FIGS. 1 and 2. In FIG. 5a, the waveform shown by a broken line is of substantially rectangular shape. This is because, in the prior art, differential amplifier with a high amplification degree or a comparator is used as the difference detecting circuit 42. As seen from the curves of FIG. 5e, the phase of the signal from the adder 112 is in advance relative to that of the signal from the adder 48.

Reference is now made to FIG. 6, which illustrates a second preferred embodiment of the present invention. A difference between the circuits of FIGS. 4 and 6 is that the circuits 82, 84, 86, and 112 of the former is combined into a circuit 131 of the latter. The output terminal of the operational amplifier 70 is connected to an inverting input terminal 142 of an operational amplifier 138 over a parallel circuit consisting of a resistor 130 and a capacitor 132. A series circuit, consisting of a resistor 134 and a capacitor 136, is connected across the amplifier 138. The amplifier 138 has a non-inverting input terminal 144 grounded and an output terminal 139 connected to the pulse generator 50 of FIG. 2 through a terminal 140.

Figures 8A, 8B, 8C, 8D, 8E:
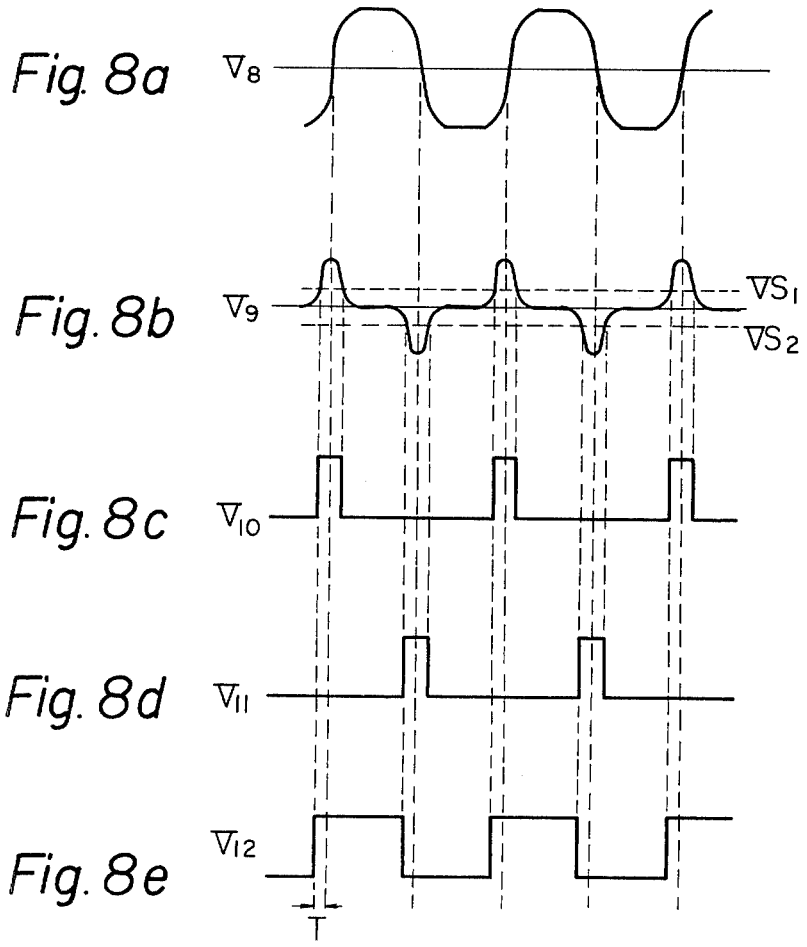

Reference is now made to FIGS. 7 and 8*a*–8*e*, wherein the former is a third preferred embodiment of the present invention and the latters are graphs showing waveforms of signals appearing at various parts of the circuit of FIG. 7. The exhaust gas sensor 2 is connected to a differentiator 147 of a difference detecting circuit 145 through a terminal 146, and applying its output signal V8 to the differentiator 147. The differentiator 147 consists of a capacitor 148 and a resistor 150. The signal applied to the differentiator 147 is differentiated therein and the differentiated signal V9 is then fed to two comparators 154 and 158. The comparator 154 generates a signal V10 which takes a higher value when the voltage of the signal V9 is above a voltage VS1 fed to the comparator 154 through a terminal 152, and otherwise takes a lower value. On the other hand, comparator 158 generates a signal V11 which takes a higher value when the voltage of the signal V9 is above a voltage VS2 fed to the comparator 158 through a terminal 156, and otherwise takes a lower value. The signal V10 is used to set a flip-flop 160 to cause the same to generate a signal V12 indicative of a higher value as best shown in FIG. 8*e*, and the signal V11 is used to reset the flip-flop 160 to cause the same to generate a signal indicative of a lower value. The signal V12 is then fed to a circuit 161 which is connected to the pulse generator 50 of FIG. 2 through a terminal 170. The circuit 161 consists of two resistors 162 and 164 and an operational amplifier 168, and multiplies and integrates the signal V12 fed thereto.

It is appreciated from FIGS. 8*a*–8*e* that the response of the third preferred embodiment is in advance with respect to that of the prior art by a time duration T in that the signal V8 is differentiated before being compared by the comparators 154 and 158.

In the preferred embodiments of FIGS. 4 and 6, it should be noted that the integrator or the proportional circuit can be omitted.

It is understood from the foregoing that according to the present invention we can obtain an improved electronic closed loop air-fuel ratio control system with a quick response and a precise air-fuel ratio control in the vicinity of stoichiometry.

What is claimed is:

1. An electronic closed loop air-fuel ratio control system for supplying an optimum air-fuel mixture to an internal combustion engine, which system comprises in combination:

an air-fuel mixture supply assembly;

an exhaust pipe;

an exhaust gas sensor provided in the exhaust pipe for sensing the concentration of a component in exhaust gases, generating a first signal representative thereof characterized by upper and lower constant voltage maxima and an analog region as a function of air-fuel mixture therebetween, in the vicinity of stoichiometry;

a difference detecting circuit responsive to said first signal for generating an analog second signal representative of the difference between magnitudes of the first signal from the exhaust gas sensor and a reference signal;

a control signal generator responsive to said second signal, said control signal generator including first means for differentiating the second signal, second means for integrating the second signal, third means for proportionally amplifying the second signal, said first, second and third means being electrically connected in parallel and operating on said second signal simultaneously, and fourth means for summing the output signals of said first means, said second means of said third means to produce a control signal; and an actuator provided in the air-fuel mixture supply assembly responsive to the control signal for controlling the air-fuel ratio of an air-fuel mixture fed to the engine.

2. An electronic closed loop air-fuel ratio control system as claimed in claim 1, in which the difference detecting circuit is a differential amplifier.

3. An electronic closed loop air-fuel ratio control system as claimed in claim 2, in which the control signal generator includes:

two resistors;

two capacitors;

an operational amplifier provided with two input terminals and an output terminal; and one of two resistors and one of the two capacitors being connected in parallel between the difference detecting circuit and one of the two input terminals, and the other resistor and the other capacitor being connected in series and between the output terminal and one of the two input terminals, and the other input terminal receiving a constant voltage.

* * * * *